US009163856B2

(12) United States Patent
Potter

(10) Patent No.: US 9,163,856 B2
(45) Date of Patent: Oct. 20, 2015

(54) HOT AIR HEATER AND BLOWER ASSEMBLY

(75) Inventor: Gary J. Potter, Marthasville, MO (US)

(73) Assignee: Cambridge Engineering, Inc., Chesterfield, MO (US)

( * ) Notice: Subject to any disclaimer, the term of this patent is extended or adjusted under 35 U.S.C. 154(b) by 858 days.

(21) Appl. No.: 13/385,729

(22) Filed: Mar. 5, 2012

(65) Prior Publication Data

US 2012/0227727 A1 Sep. 13, 2012

Related U.S. Application Data

(60) Provisional application No. 61/464,850, filed on Mar. 10, 2011.

(51) Int. Cl.
*F23L 15/00* (2006.01)
*F24H 3/02* (2006.01)

(52) U.S. Cl.
CPC ..... *F24H 3/025* (2013.01)

(58) Field of Classification Search
CPC ..... F23L 15/00
USPC ..... 126/116 B, 116 R, 110 B; 432/37
See application file for complete search history.

(56) References Cited

U.S. PATENT DOCUMENTS

| | | | | | |
|---|---|---|---|---|---|
| 3,151,850 | A | * | 10/1964 | Wellford, Jr. | 432/37 |
| 3,430,358 | A | * | 3/1969 | Denker | 34/222 |
| 3,993,449 | A | * | 11/1976 | Childs | 422/172 |
| 4,749,843 | A | * | 6/1988 | Abramson | 219/411 |
| 4,929,541 | A | | 5/1990 | Potter et al. | |
| 4,938,203 | A | * | 7/1990 | Thrasher et al. | 126/110 R |
| 4,967,726 | A | * | 11/1990 | Finch | 126/99 R |
| 4,993,944 | A | | 2/1991 | Potter et al. | |
| 5,083,918 | A | | 1/1992 | Potter et al. | |
| 5,399,086 | A | | 3/1995 | Potter et al. | |
| 6,526,964 | B1 | | 3/2003 | Potter et al. | |

* cited by examiner

*Primary Examiner* — Avinash Savani
(74) *Attorney, Agent, or Firm* — Paul M. Denk

(57) ABSTRACT

A gas-fired heater assembly for use in conjunction with a shrink wrap chamber or tunnel, including a gas-fired heater assembly, said gas-fired heater assembly incorporating an air intake, and having a gas port for injection of combustive gas into the heat chamber for combustion, the heated air combustion directed into the length of an associated heat box, said heat box having a designed opening for uniform dissemination of heated air into a hot air envelop, said hot air envelop being operatively associated with an air circulating blower, said air circulating blower directing air through the regions of the heat box for mixing of the circulating air with the heated air, and directing said mixture of heated air out of the hot air envelop and into the shrink wrap chamber or tunnel for shrinking polymer film about packaged goods for shipment and/or storage.

12 Claims, 6 Drawing Sheets

HOT AIR HEATER AND BLOWER ASSEMBLY

CROSS REFERENCE TO RELATED APPLICATION

This non-provisional patent application claims priority to provisional patent application having Ser. No. 61/464,850, filed on Mar. 10, 2011.

FIELD OF THE INVENTION

This invention relates to the use of a combustion gas heater for generating significant heat that is uniformly directed across the underside or other regions of a conveyor system, and incorporating a heated air circulation system, for use with shrink wrapping operations for applying polyethylene film about packaged goods, as a protection during shipment.

BACKGROUND OF THE INVENTION

Heat-shrink conveyor systems are utilized in the packaging industry to replace cardboard cartons with, in many cases, a cardboard tray and a thin film of plastic material which when heated forms around the containers to physically hold the product in place. Examples of such products include water, soda, and other flavored drink bottles or can products from soda to soup or vegetables. Electric operated heaters have been utilized to provide the elevated air temperature required to activate the "shrink" feature of the thin-film plastic material. The electric heaters normally have difficulty in sustaining a constant and uniformly disseminated elevated heat to achieve the shrink wrapping operations, and secondly, does not accommodate uniformity of circulation of the heat to assure that all aspects of the shrink wrap film is constantly exposed to the same temperature, to assure consistent and uniform shrinkage of the film during its packaging of the desired goods.

The conveyor system includes an enclosure above a moving conveyor which forms a tunnel to contain the heated air around the product passing through the chamber. The heated air passes from the chamber back across the electric heater elements and then into the re-circulating fan where it discharges back into the chamber in a re-circulating manner. Drawing air across an electrical heating bank that spans the width of the tunnel attempts to create an even temperature distribution in the chamber where the plastic material shrinkage is to take place. It is very important that the temperature in the chamber be uniform so that the plastic material shrinks evenly against the packaged product.

The operating temperature needed to accomplish the proper shrink effect in a tunnel requires that temperatures to be in excess of 350° F., however, the speed of the product moving through the tunnel may require the chamber temperature to reach temperatures approaching 450° F. The specified temperature must also be held at the set-point within very close tolerances generally within plus or minus 1%. This is important should the volume of product flowing through the tunnel change abruptly. Thus the need for a fast responding modulation controls system along with the requirement for a high turn down ratio of the heating system.

The above system temperature requirements make it difficult to address with indirect gas-fired burner/heat exchanger systems. Space for the heater section is generally limited which creates a problem for a heat exchanger that has to be de-rated at these operating temperatures to keep from exceeding the temperature limit of the material and to maintain the thermal efficiency near 80%. The lower efficiency of the heat exchanger makes it more difficult to compete against the cost of electricity in most parts of the country.

Attempting to apply a direct fired-gas burner system to such an application would have an advantage over an indirect approach because it has a 100% thermal efficiency by its very nature, however, it has been problematic because the heat source is much closer to a point source than distributed as a plane section source as is accomplished by the electric heater bank. The airflow pattern in the tunnel acts to keep the heat flow from a point source burner from reaching the far side of the tunnel, so one cannot mount a burner on one side of the chamber and expect that the temperatures will eventually equalize. Furthermore, the confines of the conveyor cabinet limits the amount of air mixing devices that can be added to match the uniform temperature profile produced from the electric heating system. A solution to this condition is therefore the basis for this patent application.

The operating cost difference between electrical power cost and the cost of natural gas operating at a thermal efficiency of 100% more than justifies a solution to overcome the obstacles that had thus far blocked the entry of a direct gas-fired system from breaking through as a viable alternative to the electric heater in this market.

It becomes obvious that other specialized-heating applications that have similar issues as are encountered with the shrink-wrap conveyer systems as described above would benefit from the solutions offered by this invention. This is a common problem when the heat source tends to act as a point source rather than a distributed output such as a planer source like a heating element bank when the airflow is perpendicular to the heat source. A similar problem exists when a point heat source is small in comparison to the plane of the airflow pattern when the airflow is in the same directions as the heat output. The velocity of the system fan tends to keep the high temperature air from mixing evenly.

SUMMARY OF THE INVENTION

This invention contemplates the usage of a direct gas-fired burner to furnish elevated and uniform heat for application in an effective shrink wrapping operation that uses polymer to wrap goods for shipment and/or storage.

A direct gas-fired burner with an embedded combustion air fan is employed as a point heat source that is firing through the sidewall of a shrink-wrap conveyor where the internal airflow is flowing from left to right. An insulation box provides the wall interface for mounting the assembly to the conveyor chamber wall. The outlet of the burner penetrates through the insulation box and into the chamber itself. A heat box captures all of the hot air leaving the burner outlet which in turn pressurizes the heat box by the airflow associated with the combustion air fan. The heat box protects the heat leaving the burner from any disturbance by the circulating airflow of the conveyor fan while the heated air remains inside the heat box.

The key to providing a solution for distributing the heat evenly across the width of the conveyor and within the limited area or confines of the assembly is to have the heat box itself traverse across the width of the chamber and then allow the heated air to escape evenly through a linear slot along its length or a series of punched holes. In the present invention, a partially open outlet slot applies a back pressure on the heated air within the heat box cavity which serves to equalize the air velocity leaving the heat box through such linear slot. A baffle has been installed under the linear slot to block flame from directly entering the linear slot. The baffle assembly provides a path around the bottom baffle with slot openings on each side, below the linear slot to lengthen the heated air path for better mixing and minimize the possibility of flame escaping or passing through the linear slot.

As mentioned earlier, it is acknowledged that, in lieu of a slot configuration, a series of properly sized perforated holes in the heat box could accomplish the same end result and therefore should be recognized by those skilled in the art that adequate results could be achieved with an alternate method of obtaining an even airflow of a mixed heated air output from a heat box.

The heat box is surrounded by a hot air envelop designed to direct the circulating air over the surfaces of the heat box with the larger air volume from the circulating fan passing through the heated air leaving the heat box through the linear slot. The circulating fan airflow dilutes the heated air leaving the heat box. The volume relationship of the circulating fan to that of the combustion air fan is generally 15 to 30 times as much flow, therefore the dilution effect of the circulating airflow effectively decreases the overall temperature of the heated air leaving the linear slot to significantly closely approach the desired chamber temperature. The top surface of the hot air envelop is solid to act as a hit zone for the heated air so as to absorb any hot spots that are not thoroughly distributed by the circulating fan of the chamber including the possibility of flame tips.

It is also recognized that this solution of linearizing the output of a point source heat generating device would apply to other types of heat generating equipment besides the gas burner that was the bases for this patent protection submission. Theoretically, an electric hair dryer could be used as a point source heat generating device.

From empirical data, it was found that a slot block-off which is located above the end point of the burner was necessary to equalize the air temperature inside of the conveyor chamber to maintain the temperature variance tolerance desired. This slot block-off was utilized to address a hot spot area associated at the point where flames were exiting the burner.

A significant benefit of capturing the burner heat output in a heat box as described is that it eliminates the possibility of flame impingement by the airflow from the circulating fan. Testing conducted prior to incorporating the heat box in the design resulted in significantly higher levels of combustion products such as carbon monoxide (CO) and nitrogen oxides ($NO$, $NO_2$, and $NO_x$). The shielding of the flames and capturing of the heat in the confines of the heat box before discharging the heated air out of the linear slot was absolutely necessary to attain acceptance by the end user desirous of utilizing the gas heat solution.

It is, therefore, a principle object of the current invention to provide a direct gas-fired burner assembly for generating significant heat that is uniformly distributed and dispersed within the circulating air that is applied to furnish shrink wrapping of polymer film about packaged goods.

Another object of this invention is to provide a gas-fired burner that can significantly elevate the generated temperature of a shrink wrap chamber to attain uniformity of shrinkage of the polymer film applied about packaged goods.

Still another object of this invention is to provide a gas-fired burner that may be used directly in proximity with the conveyor carrying polymer wrapped goods through a heat chamber to attain uniformity of shrinkage of the polymer film during packaging.

Still another object of this invention is to provide a direct gas-fired burner that operates in conjunction with a heat box, and a hot air envelop that provides for uniformity of circulation of heated air within a shrink wrap operation.

Still another object of this invention is to provide a gas-fired burner and its operative assemblies that incorporate components that assure the uniform dissemination of heat, from the burner, as it circulates within the chamber of a shrink wrapping assembly.

These and other objects may become more apparent to those skilled in the art upon review of the summary of the invention as provided herein, and upon undertaking a study of the description of its preferred embodiments, in view of the drawings.

DESCRIPTION OF THE PREFERRED EMBODIMENT

Figure 1:
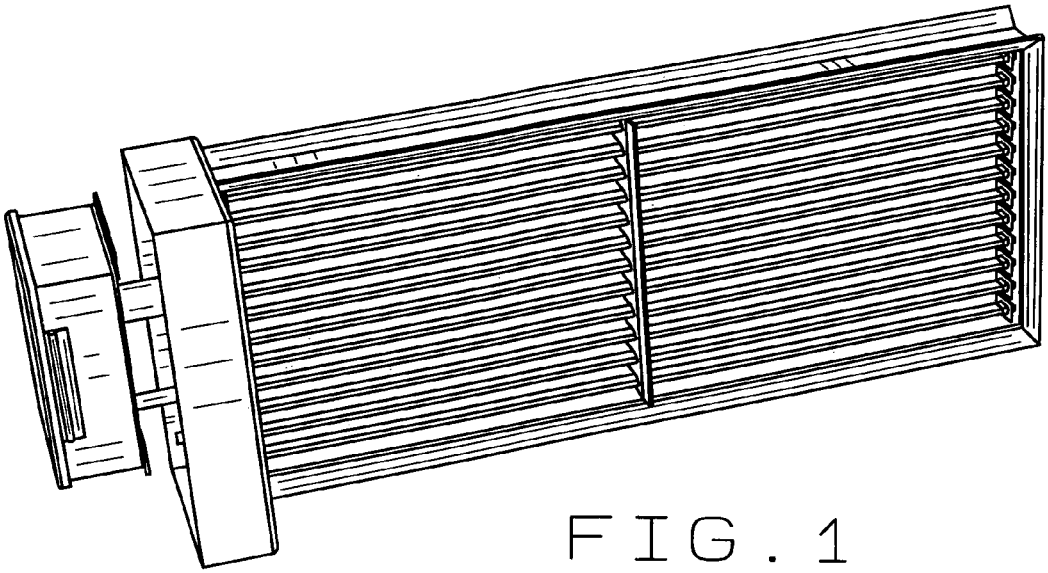
FIG. 1 PRIOR ART
FIG. 1 provides an illustration of an electric heater bank with insulation box and electrical junction box as known in the prior art.

In referring to the drawings, and in particular FIG. 1, therein is depicted the current version of an electric heater bank that includes the insulation box, and the electrical junction box. This design has electric heating elements that traverse the full width of the assembly that is inside the chamber being heated as well as staked one on top of the other to fill the full open height of the shown chamber. One can easily understand the result in uniformity of the temperature spectrum as air is drawn through the heater element and into the blower inlet.

Figure 2:
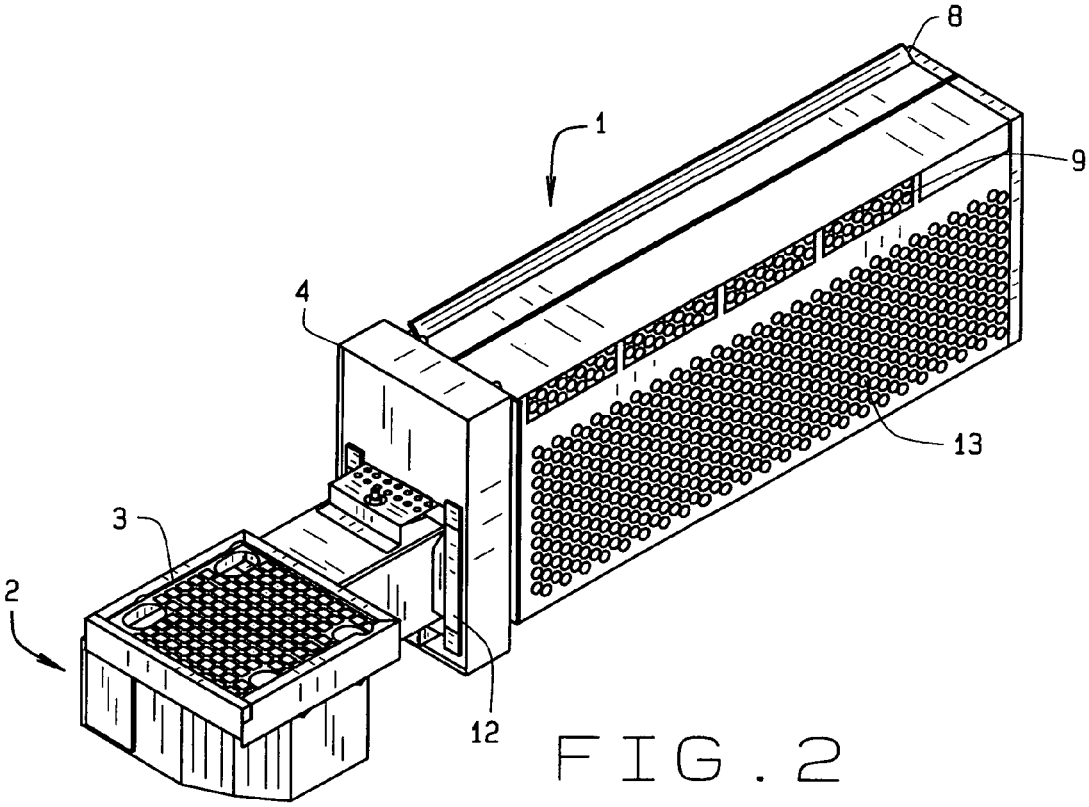
FIG. 2 shows an isometric view of the direct gas-fired burner assembly of the current invention packaged within its heat box, and located within its hot air envelop that assures uniform distribution and circulation of the heated air within the shrink wrap chamber to provide uniform circulation of the heated air throughout the shrink wrap chamber or tunnel.

FIG. 2 shows the gas-fired heater assembly 1 of the current invention, and which includes the assembly burner 2, that features an embedded combustion air blower that supplies the air to the burner section necessary for attaining complete combustion. As can be understood, a major portion of the flame is contained within the burner when firing below 225 thousand BTU's/hr, and any flames that extend past the end of the burner at firing rates above that amount up to its rated capacity of 330 thousand BTU's/hr may attain an approximately 12 inch flame that is forward of the burner structure. A filter housing 3 houses an intake filter to block debris from entering the burner assembly. The gas-fired burner assembly attaches to an insulation box 4.

The heat box 5 (see FIG. 3) attaches to the backside of the insulation box 4. The heat box is allowed to float or is cantilevered on its opposite end, as at 6, to accommodate for expansion from the generated heat. There is formed a linear slot 7 provided through the top surface of the heat box, and this is where the heated air is discharged from the heat box, although, obviously, the surfaces of the heat box likewise conduct and radiate significant energy to the ambient air that passes over these surfaces, during operations of the assembly. A hot air envelop 8 is also provided, and attaches with the insulation box 4, and is also retained by angled brackets on the top and bottom surfaces of the envelop 8. As can be seen in FIG. 2, the hot air envelop 8 totally encapsulates the heat box 5. The envelop 8 is supplied with openings and larger cutouts, as at 9, to minimize the restriction to the flow of air across the heat box, and through the hot air envelop assembly 8. These openings are intended to let air impinge on all of the surfaces of the heat box, during its operations, and with these larger cutouts it permits higher air flow volumes to pass across the top of the heat box and to disburse the heat discharge through the linear slot 7, as can be noted. The top of the envelop 8 forms a barrier between the heat box, and the roof section to any shrink wrap chamber or tunnel, in which this assembly is used, to avoid the chamber roof or walls from experiencing directly the heated air being expelled through the linear slot of the heat box 5.

Figure 3:
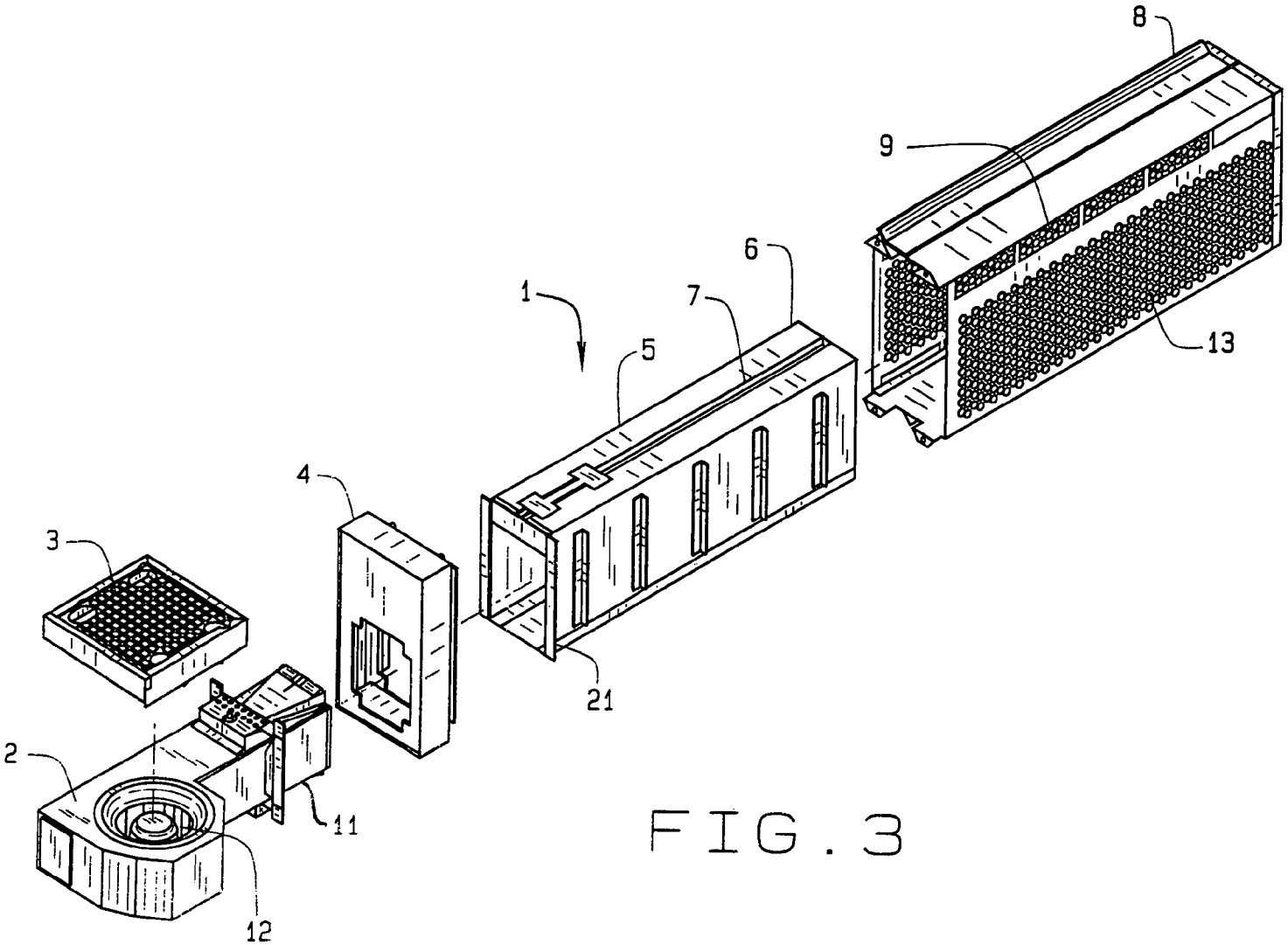
FIG. 3 provides an exploded view of the direct gas-fired burner assembly of this invention.

Thus, as can be further seen in FIG. 3, the exploded view of the assembly 1 shows the burner assembly 2, with its impeller 10 to further aid in the draw in of air for combustion purposes, the heater itself can be seen at 11, and this heater is related to the style of heater that has been made by the assignee herein, for some time, and as can be noted in U.S. Pat. Nos. 4,929,541, 4,993,944, 5,083,918, 5,399,086 and 6,526,964. In addition, the filter 3 can be noted, in addition to the insulation box 4, to which the burner 11 secures, by means of brackets, as can be seen at 12.

Figure 4:
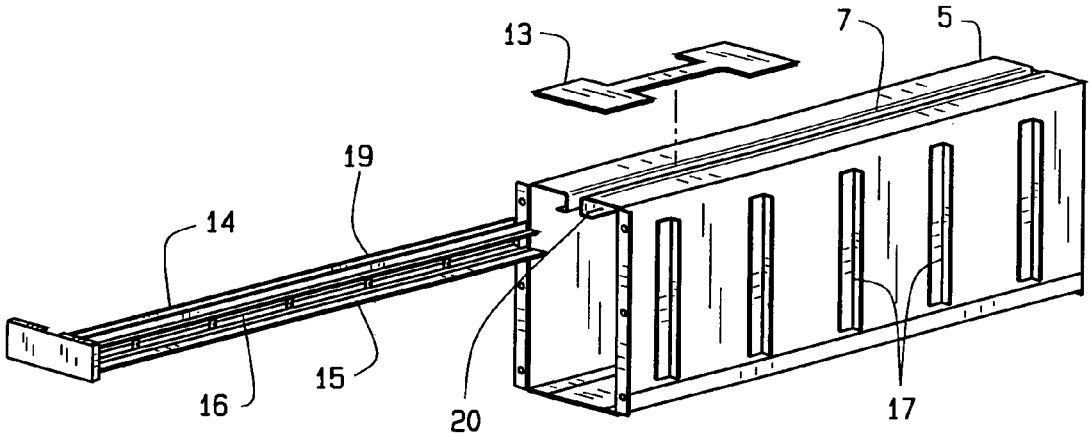
FIG. 4 provides an exploded and isometric view of the heat box of the current invention.

FIG. 4 shows a further exploded view of the components that make up the heat box design 5, and includes its linear heat discharging slot 7, as can be noted. The linear slot block-off 13 is positioned over the intake end of the heat box, just downstream from the burner, and the purpose of the block-off is to minimize the impact of the hotter air coming directly off of the flame tips, from the burner assembly, from causing a noticeable temperature difference within the chamber, when the object is to attain uniformity of temperature, throughout its length, to assure that all portions of the shrink wrap material will be exposed to the same quantity of heat, to furnish uniform shrinkage of the polymer film about the packaged goods being conveyed through the chamber or shrink wrap tunnel. This emphasis on maintaining uniformity of temperature throughout the length of the assembly is essential to specifically address the derived empirical data as collected during evaluation of the system performance, to attain highly efficient shrink wrappage during usage of the assembly. The flame shield air mixer 14 attaches to the linear slot structure 7, to block the flame tips from entering the passageway of the linear slot by forcing them to travel around the block-off portion, as noted at 15, of this assembly and then travel back before entering the slotted openings, as at 16, below the linear slot 7. The devised means is very effective in accommodating the maintenance of uniformity of the desired degree of air mixing before it enters into and through the linear slot 7, for passage into the envelop 8. In addition, stiffening spacers 17 are affixed to the sides of the heat box 5, to minimize any deformation to the structure of the box generated from the elevated temperatures that are encountered internally of the box during operations of the combustion assembly. These spacers also serve to control the gap between the heat box 5, and the envelop 8. The close proximity of the perforated sides of the envelop 8, as can be noted at 18, to the heat radiating sides of the heat box 5 can possibly deform the envelop side surfaces, prior to the addition of the stiffening spacers 17, as explained. These stiffening spacers are not attached to the envelop 8, so as not to restrain any movement of the heat box, as its metal expands from the generated elevated temperatures therein, during functioning of the gas-fired heater assembly, located within the approximate end of the heat box in its structure.

Figure 5:
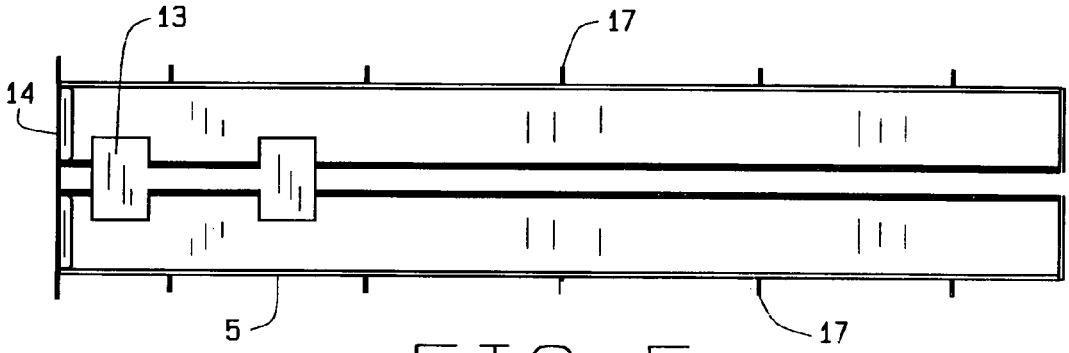
FIG. 5 provides a plan view of the heat box and its heated air mixer in combination with the linear slot baffle that induces a more longitudinal dissemination of the generated heat out of its said heat box.

FIG. 5 shows the arrangement of the heat box 5, with its flame shield air mixer 14 applied therein, and during its application, its upper flanges, as at 19, may slide upon the linear slot flanges 20 and to be held in position thereto. In addition, the block-off 13 which functions as previously described, locates at that end of the heat box 5 in proximity with the front end of the burner 11, in order to help regulate the flow of heat, as previously explained. The spacers 17 can also be seen applied laterally of the outer surfaces of the heat box, as can be noted.

Figure 6:
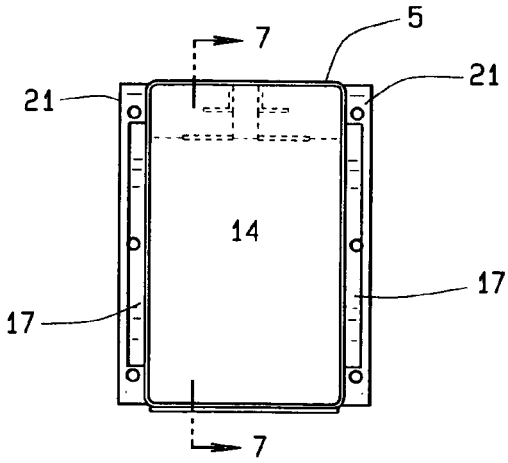
FIG. 6 provides an end view of the heat box shown in FIG. 5.

FIG. 6 shows a backend view of the heat box 5 disclosing its spacers 17 upon its sides, in addition to the mounting flanges 21 to which the insulation box 4 attaches. Also shown internally thereof, in hidden line, is the location of the flame shield air mixer 14, as can be noted. As can be seen in FIG. 4, that air mixer 14 extends almost the full length of the heat box 5, in its installation.

Figure 7:
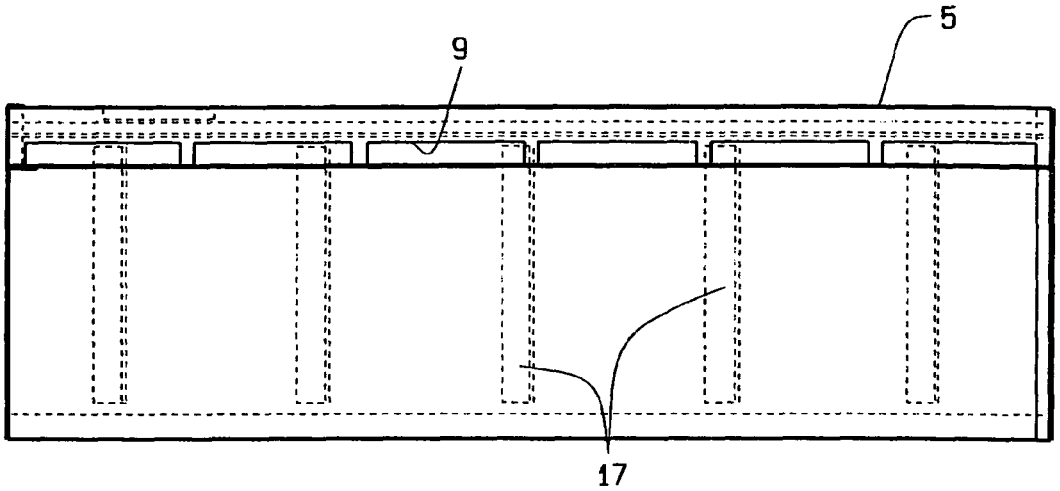
FIG. 7 provides a side view of the heat box and its stiffening spacers taken along the line 7-7 of FIG. 6.

FIG. 7 provides a sectional view of the heat box, as contained within its envelop 5, and this sectional view is taken along the line 7-7 of FIG. 6. As can be noted, the stiffeners 17 are provided upon the heat box, as it is contained within the envelop 5. Also, there are shown the cutouts or openings 9 of the envelop, through which a substantial amount of the circulating air passes, as to be subsequently described, in picking up uniformly the heat generated within the heat box, as passing through its linear slot 7, into said envelop.

Figure 8:
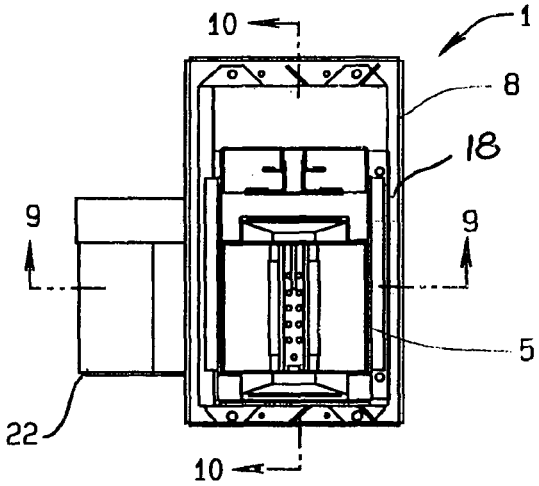
FIG. 8 is a left end view of the combined heat box, the hot air envelop, and the air circulating system of the current invention.
Figure 9:
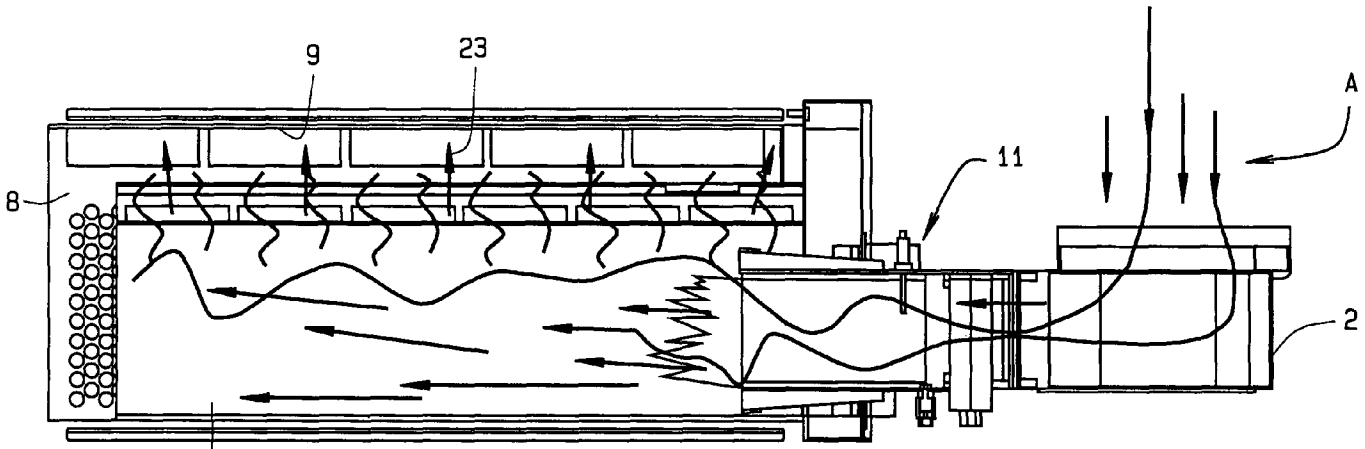
FIG. 9 is a side schematic view of the direct gas-fired burner mounted within its heat box, and contained within its hot air envelop, and showing the circulating heat and air patterns generated during the operations of this current invention.
Figure 10:
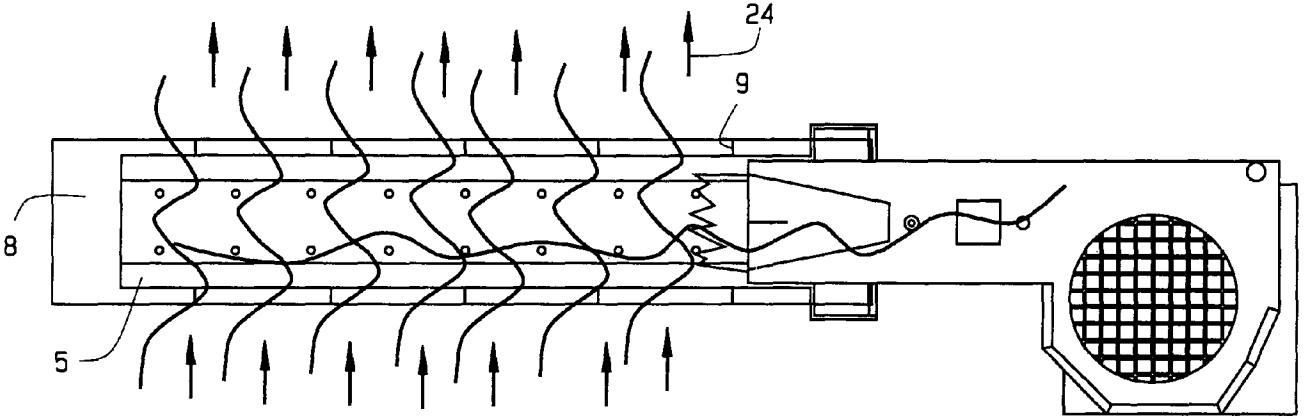
FIG. 10 is a top view showing the heated air circulating patterns of the operating system.

FIG. 8 provides the various sectional views of the gas-fired heater assembly 1 and in combination with the sectional views 9-9, as shown in FIG. 9, and the sectional view 10-10, as shown in FIG. 10, shows the airflow from the circulating means as applied in combination with the assembly, to furnish a pickup of the heated air and to pass it into the shrink wrap chamber or tunnel, wherein the product conveyor may locate, during operations of the device.

FIG. 8 does show the combination of the heat box 5, located within the hot air envelop 8, in addition to the laterally applied heated air circulating fan 22, which provides for the forced application of circulating air through the envelop 8, particularly upwardly over the heat box 5, to direct the disbursal of uniformly heated air into the shrink wrap chamber or tunnel, during operations of the device.

As can be noted in the schematics of FIG. 9, the incoming combustible air, as at A, enters into the burner assembly 2, enters into the gas burner assembly 11, where the air along with the gas from the burner ignites, to produce the quantity of heated air, within the heat box 5, as can be noted. The heated air within the heat box 5 rises upwardly, after its uniform distribution along the length of the heat box 5, and passes out of the slot 7, as can be noted at 23. At this location, the circulating air from the fan 22 picks up the heated air, and passes it through the openings 9 of the hot air envelop 8, for distribution into the shrink wrap chamber or tunnel, as known in the art.

FIG. 10 shows the passage of the circulating air from the fan operation 22 (see FIG. 8) with the air passing horizontally, as at 24, around the heat box 5, and through the internal regions of the hot air envelop 8, for passage out of the its openings 9, and for distribution of the heated air into the aforesaid shrink wrap chamber or tunnel. As previously summarized, the volumetric relationship of the air directed by the circulating fan 22, as it picks up the heated combustion air from the burner assembly, is somewhere in the range of approximately 15 to 30 times circulation air to heated combustion air, therefore providing the dilution effect of the circulating air flow to effectively decree the overall temperature of the heated air leaving the linear slot 7 of the heat box, and to attain that uniformity of generated temperature somewhere in excess of 350° F., but below approximately 450° F., for that air circulated into the heat shrink chamber or tunnel, during functioning of this device.

Figure 11:
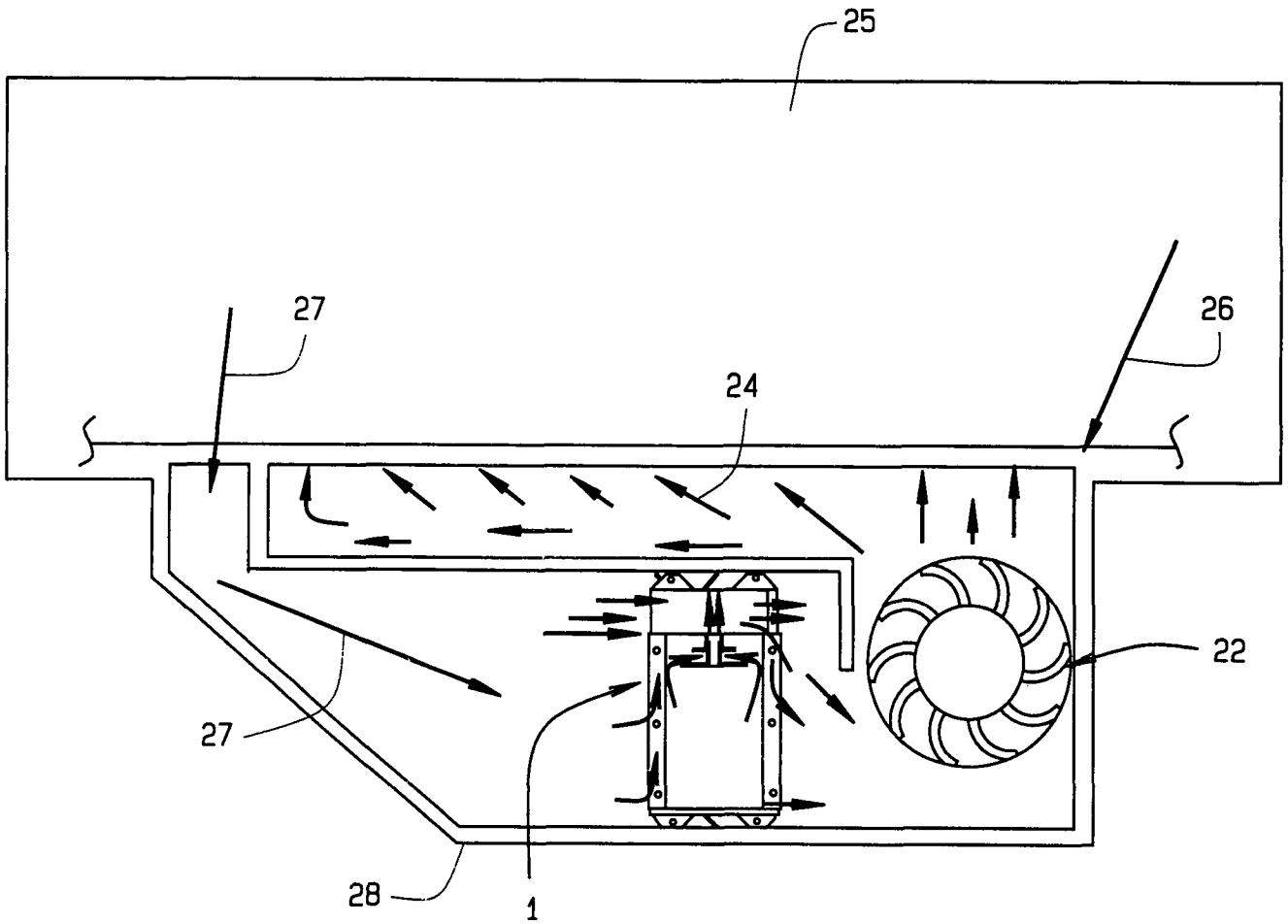
FIG. 11 shows an open ended view of the direct gas-fired burner assembly of the current invention, contained within its hot air envelop, creating a path for heated air, and the air circulating system used in combination with the burner assembly to circulate the heated air around the conveyor system of a shrink wrap chamber or tunnel.

FIG. 11 shows a representative sectional view of a shrink wrap conveyor system, with the gas-fired burner assembly 1 provided therein, and how the air circulating fan 22 picks up the heated air, intermixes the two airflows, and delivers the diluted heated air 24 into the shrink wrap chamber or tunnel 25 during the operations of this device. As can be noted, the diluted heated air passes around or through the conveyor 26, which may be a mesh type metallic conveyor that conveys the polymer film wrapped goods through the chamber, in order to induce the shrinkage of the film, about the packaged goods, in preparation for shipment or storage. Any excess heated air within the chamber can be re-circulated, as noted at 27 back through the housing 28 holding the gas-fired heater assembly 1, pass it back through the openings or slots 9 of the hot air envelop, for recirculation by the operations of the fan 22, back into the chamber, during operations of this device.

Variations or modifications to the subject matter of this invention may occur to those skilled in the art upon review of the development as described herein. Such variations, if within the spirit of this invention, are intended to be encompassed within the scope any claims to patent protection issuing hereon. The summary of the invention herein, its depiction in the drawings, and description in the preferred embodiment, are intended for illustrative purposes only.

I claim:

1. A gas-fired heater assembly, said heater assembly comprising a gas-fired heater, a heat box, said gas-fired heater connecting to said heat box, a combustion air fan, said combustion air fan connecting with the gas-fired heater, and provided for directing air into the combustion area of the gas-fired heater, and for further urging the heated air into the heat box, a hot air envelop, said heat box locating within said hot air envelop, and extending substantially the length of said envelop, said heat box having an outlet for directing the heated air and discharging it uniformly along substantially the length of the said envelop, said hot air envelop having at least one opening providing therethrough, said heat box including a slot provided substantially along its upper surface, approximately along its length, and providing for the uniformed distribution of heated air into the hot air envelop during operations of the assembly, an air circulating blower operatively associated with the hot air envelop, and provided for forcing and circulating air to pass through the said envelop, by way of its opening, to provide for intermixing of the heated air with the circulating air, and discharging said mixed air from the hot air envelop into a heat shrink chamber or tunnel to provide for shrinking the polymer film applied around packaged products for transfer or storage.

2. The assembly of claim 1 and including said heat box having a series of external fins provided along the surface of its sides, to function as spacers between the heat box and the hot air envelop during operations of the assembly.

3. The assembly of claim 2 and wherein said heat box being mounted to one end of the hot air envelop, and being cantilevered therein to accommodate any expansion due to exposure to the generated heat during operations of the gas-fired heater assembly.

4. The assembly of claim 3, wherein said hot air envelop includes a series of perforations upon its sides, to allow for the circulating blower air to be exposed to the surfaces of the heat box and to absorb heat therefrom during circulation of the heated air during operations of the assembly.

5. The heater assembly of claim 4 and wherein the circulating blower air intermixes with the heater assembly air to provide for delivery of uniformly heated air flow to all sections of the shrink wrap system to provide for uniformity of shrinkage of the polymer film about the packaged goods during processing.

6. The assembly of claim 5 wherein said hot air envelop includes a solid top, said solid top of the hot air envelop being located above the linear slot of the heat box, and thereby provides for concentration of heat along the length of the upper interior of said hot air envelop to provide for its uniform intermixing with the circulating blower air for delivery to the chamber of the shrink wrap housing.

7. The assembly of claim 6 and including a flame shield air mixer engaging internally with the formed linear slot of the heat box, to provide for uniform distribution of the heated air into the upper regions of the hot air envelop to assure uniformity of intermixing with the circulating blower air for its delivery into the housing of the shrink wrap chamber.

8. The assembly of claim 7 and including a flame baffle provided upon the heat box, proximate the location of the connection of the gas-fired heater thereto, to prevent the development of hot spots at that location of the heat box during operations of the burner and the heater assembly.

9. The heater assembly of claim 7, wherein said flame shield air mixer slidingly engages with the heat box throughout the approximate length of its formed linear slot.

10. The heater assembly of claim 1 and wherein said air blower fan attaches with and locates laterally of the hot air envelop.

11. The heater assembly of claim 1, wherein said combustion air fan of the burner assembly delivers air for heating through the burner assembly and into the heat box, while the air circulating fan forces air through the hot air envelop for intermixing and diluting the heated air from the hot box for uniform delivery of the heated air to the shrink wrap chamber during operations of the gas-fired heater assembly.

12. The heater assembly of claim 1 and including an insulation box interconnecting between the burner assembly and the heat box to minimize the migration of generated heat from the burner assembly back to the combustion air fan during its operations.

* * * * *